US009334754B2

(12) United States Patent
Khanin et al.

(10) Patent No.: US 9,334,754 B2
(45) Date of Patent: May 10, 2016

(54) AXIAL FLOW GAS TURBINE

(75) Inventors: Alexander Anatolievich Khanin, Moscow (RU); Valery Kostege, Moscow (RU)

(73) Assignee: ALSTOM TECHNOLOGY LTD., Baden (CH)

( * ) Notice: Subject to any disclaimer, the term of this patent is extended or adjusted under 35 U.S.C. 154(b) by 756 days.

(21) Appl. No.: 13/306,072

(22) Filed: Nov. 29, 2011

(65) Prior Publication Data

US 2012/0134781 A1 May 31, 2012

(30) Foreign Application Priority Data

Nov. 29, 2010 (RU) ..... 2010148728

(51) Int. Cl.
*F01D 25/12* (2006.01)
*F01D 5/18* (2006.01)

(52) U.S. Cl.
CPC ..... *F01D 25/12* (2013.01); *F01D 5/187* (2013.01); *F05D 2240/126* (2013.01); *F05D 2240/15* (2013.01); *F05D 2260/201* (2013.01); *F05D 2260/205* (2013.01)

(58) Field of Classification Search
CPC ..... F01D 25/10; F01D 25/12; F01D 25/14; F01D 29/4246; F01D 5/187; F05D 2240/15; F05D 2240/126; F05D 2260/201; F05D 2260/205
USPC ..... 415/115, 116, 108, 177, 173.1, 173.5, 415/173.6, 174.5, 110, 168.1, 174
See application file for complete search history.

(56) References Cited

U.S. PATENT DOCUMENTS

| | | | | |
|---|---|---|---|---|
| 2,863,634 | A | 12/1958 | Chamberlin et al. | |
| 3,628,880 | A * | 12/1971 | Smuland et al. | 415/175 |
| 3,975,901 | A * | 8/1976 | Hallinger et al. | 60/786 |
| 4,280,792 | A * | 7/1981 | Hartel et al. | 415/117 |
| 4,311,431 | A * | 1/1982 | Barbeau | 415/173.6 |
| 4,522,557 | A * | 6/1985 | Bouiller et al. | 415/115 |
| 4,573,865 | A * | 3/1986 | Hsia et al. | 415/115 |
| 4,693,667 | A * | 9/1987 | Lenz et al. | 415/115 |
| 4,702,670 | A * | 10/1987 | Winter | 415/116 |
| 4,946,346 | A * | 8/1990 | Ito | 415/115 |

(Continued)

FOREIGN PATENT DOCUMENTS

| | | |
|---|---|---|
| CN | 1568397 A | 1/2005 |
| EP | 1 213 444 A2 | 6/2002 |

(Continued)

OTHER PUBLICATIONS

First Office Action dated Jul. 2, 2014 issued in corresponding Chinese Patent application No. 2011104079733, and an English translation thereof (13 pages).

(Continued)

*Primary Examiner* — Craig Kim
*Assistant Examiner* — Wayne A Lambert
(74) *Attorney, Agent, or Firm* — Buchanan Ingersoll & Rooney PC

(57) ABSTRACT

In an axial flow gas turbine (30), a substantial reduction of the consumption of cooling air can be achieved by providing, within a turbine stage (TS), structure (39-44) to reuse the cooling air that has already been used to cool, especially the airfoils of, the vanes (33) of the turbine stage (TS), for cooling the stator heat shields (38) of that turbine stage (TS) downstream of the vanes (33).

2 Claims, 5 Drawing Sheets

(56) References Cited

U.S. PATENT DOCUMENTS

| | | | | |
|---|---|---|---|---|
| 5,344,283 | A * | 9/1994 | Magowan et al. | 415/115 |
| 5,417,545 | A * | 5/1995 | Harrogate | 415/115 |
| 5,871,333 | A * | 2/1999 | Halsey | 415/173.1 |
| 5,899,660 | A * | 5/1999 | Dodd | 415/9 |
| 5,993,150 | A * | 11/1999 | Liotta et al. | 415/115 |
| 6,089,822 | A * | 7/2000 | Fukuno | 415/115 |
| 6,126,390 | A * | 10/2000 | Bock | 415/115 |
| 6,179,557 | B1 * | 1/2001 | Dodd et al. | 415/115 |
| 6,431,820 | B1 * | 8/2002 | Beacock et al. | 415/1 |
| 6,435,813 | B1 * | 8/2002 | Rieck et al. | 415/115 |
| 6,641,363 | B2 * | 11/2003 | Barrett et al. | 415/116 |
| 6,779,597 | B2 * | 8/2004 | DeMarche et al. | 165/169 |
| 7,097,418 | B2 * | 8/2006 | Trindade et al. | 415/115 |
| 7,104,751 | B2 * | 9/2006 | Naik et al. | 415/116 |
| 7,246,989 | B2 * | 7/2007 | Glasspoole et al. | 415/1 |
| 7,520,719 | B2 * | 4/2009 | Janke et al. | 415/176 |
| 7,604,453 | B2 * | 10/2009 | Lee et al. | 415/1 |
| 7,611,324 | B2 * | 11/2009 | Lee et al. | 415/1 |
| 7,690,885 | B2 * | 4/2010 | Lee et al. | 415/1 |
| 7,938,621 | B1 * | 5/2011 | Balsdon et al. | 415/173.1 |
| 7,946,801 | B2 * | 5/2011 | Shapiro et al. | 415/1 |
| 7,972,107 | B2 | 7/2011 | Dervaux et al. | |
| 2002/0148233 | A1 | 10/2002 | Tiemann | |
| 2003/0035717 | A1 * | 2/2003 | Tiemann | 415/115 |
| 2004/0258517 | A1 * | 12/2004 | Naik et al. | 415/116 |
| 2004/0258523 | A1 * | 12/2004 | Naik et al. | 416/116 |
| 2008/0131263 | A1 * | 6/2008 | Lee et al. | 415/115 |
| 2008/0190114 | A1 * | 8/2008 | Surace et al. | 60/806 |
| 2009/0081027 | A1 * | 3/2009 | Khanin et al. | 415/170.1 |
| 2012/0257954 | A1 * | 10/2012 | Chanteloup et al. | 415/1 |

FOREIGN PATENT DOCUMENTS

| | | | |
|---|---|---|---|
| EP | 2 075 437 | A2 | 7/2009 |
| GB | 1 484 288 | | 9/1977 |
| JP | 9-177503 | A | 7/1997 |
| JP | 2007-270834 | A | 10/2007 |

OTHER PUBLICATIONS

Office Action (Notification of Reasons for Refusal) issued Oct. 27, 2014 in corresponding Japanese Patent Application No. 2011-260781, and an English translation thereof.

Extended European Search Report issued Oct. 29, 2014 in corresponding European Patent Application No. 11190649.1.

Search Report dated May 11, 2011 issued by the European Patent Office in corresponding Swiss Application No. 20342010.

* cited by examiner

AXIAL FLOW GAS TURBINE

This application claims priority under 35 U.S.C. §119 to Russian Federation application no. 2010148728, filed 29 Nov. 2010, the entirety of which is incorporated by reference herein.

BACKGROUND

1. Field of Endeavor

The present invention relates to gas turbines, and in particular to axial flow gas turbines.

2. Brief Description of the Related Art

The invention relates to an axial flow gas turbine, an example of which is shown in FIG. 5. The gas turbine 10 of FIG. 5 operates according to the principle of sequential combustion. It includes a compressor 1, a first combustion chamber 4 with a plurality of burners 3 and a first fuel supply 2, a high-pressure turbine 5, a second combustion chamber 7 with the second fuel supply 6, and a low-pressure turbine 8 with alternating rows of vanes 13 or 33 and blades 16 or 36, which are arranged in a plurality of turbine stages arranged along the machine axis 9.

The gas turbine 10 according to FIG. 5 includes a stator and a rotor. The stator includes a housing with the vanes 13, 33 mounted therein; these vanes 13, 33 are necessary to form profiled channels where hot gas developed in the combustion chamber 7 flows through. Gas flowing in the required direction hits against the blades 16, 36 installed in shaft slits of a rotor shaft and causes the turbine rotor to rotate. To protect the stator housing against the hot gas flowing above the blades 16, 36, stator heat shields installed between adjacent vane rows are used. High temperature turbine stages require cooling air to be supplied into vanes, stator heat shields and blades.

A section of a typical cooled gas turbine stage TS of a gas turbine 10 is shown in FIG. 1. Within a turbine stage TS of the gas turbine 10, a row of vanes 13 is mounted on a vane carrier 11. Downstream of the vanes 13 a row of rotating blades 16 is provided, each of which has an outer platform 17 at its tip. Opposite to the tips of the blades 16, stator heat shields 18 are mounted on the vane carrier 11. Each of the vanes 13 has an outer platform 14. The vanes 13 and blades 16 with their respective outer platforms 14 and 17 border a hot gas path 12, through which the hot gases from the combustion chamber flow.

To ensure operation of such a high temperature gas turbine 10 with long-term life span, all parts forming its flow path 12 should be cooled effectively. Therefore, cooling air 23 is directed through respective cooling bores 21 and 22 from a plenum 20 to the stator heat shields 18 and vanes 13 and hot outer platforms 17 of the blades 16. However, the known turbine design of FIG. 1 requires sufficient additional amount of cooling air 23 to be supplied into a cavity 19 on the back of the stator heat shields 18 to cool those stator heat shields and the outer blade platform 17, and this feature can be considered as a shortcoming of this design. Another drawback is the traditional way of stator heat shield fixation, where a gap exists between a vane 13 and the stator heat shield 18 (see the encircled zone A in FIG. 1), and a portion of cooling air leaks from the cavity 19 through that gap into the turbine flow path 12 (see arrows in the zone A).

SUMMARY

One of numerous aspects of the present invention includes a gas turbine with a turbine stage cooling scheme, which can avoid drawbacks of the known cooling configuration and substantially reduce the consumption of cooling air within the turbine stage.

Another aspect includes an axial flow gas turbine that comprises a rotor with alternating rows of air-cooled blades and air-cooled rotor heat shields, and a stator with alternating rows of air-cooled vanes and air-cooled stator heat shields mounted on a vane carrier, whereby the stator coaxially surrounds the rotor to define a hot gas path in between, such that the rows of blades and stator heat shields, and the rows of vanes and rotor heat shields are correlated with each other, respectively, and a row of vanes and the next row of blades in the downstream direction define a turbine stage. Within a turbine stage, means are provided to reuse the cooling air that has already been used to cool, especially the airfoils of, the vanes of the turbine stage, for cooling the stator heat shields of that turbine stage downstream of the vanes.

According to an embodiment, the means for reusing comprises first means for collecting the used cooling air when exiting the vanes, and second means for directing the collected used cooling air onto the stator heat shields of said turbine stage downstream of the vanes, for cooling.

Preferably, the means for reusing further comprises third means for directing the collected used cooling air onto outer platforms of the blades of said turbine stage downstream of the vanes, for cooling.

According to another embodiment, the vanes of the turbine stage each comprise an outer platform, and the means for reusing are integrated into the vanes just above the outer platforms.

According to another embodiment, the collecting means comprises a first cavity for each of the vanes located at the exit of the vane cooling air on the upper side of the outer platform, the directing means comprises a second cavity extending in the circumferential direction and being connected to said first cavity, whereby a plurality of first, axially oriented holes, which are equally distributed along the circumferential direction, direct used cooling air from the second cavity onto the outside of the adjacent stator heat shields of the turbine stage, for cooling.

According to another embodiment, a plurality of second axially oriented holes, which are equally distributed along the circumferential direction, direct used cooling air from the second cavity onto the outside of the outer platforms of the adjacent blades of the turbine stage, for cooling.

Preferably, the outer platforms of the blades of the turbine stage each comprise a circumferentially oriented forward tooth, the vanes of the turbine stage overlap said forward tooth with a circumferentially extending downstream projection at the rear wall of their outer platform, and each downstream projection is provided with a honeycomb just opposite to the forward tooth.

According to another embodiment, the first cavity is established by a rib in the form of a frame on the upper side of the outer platform, which frame is covered by a sealing screen.

According to another embodiment, the second cavity is established by a recess in the rear wall of the outer platform, which recess is covered by a sealing screen.

BRIEF DESCRIPTION OF THE DRAWINGS

The present invention is now to be explained more closely by means of different embodiments and with reference to the attached drawings.

DETAILED DESCRIPTION OF EXEMPLARY EMBODIMENTS

Figure 2:
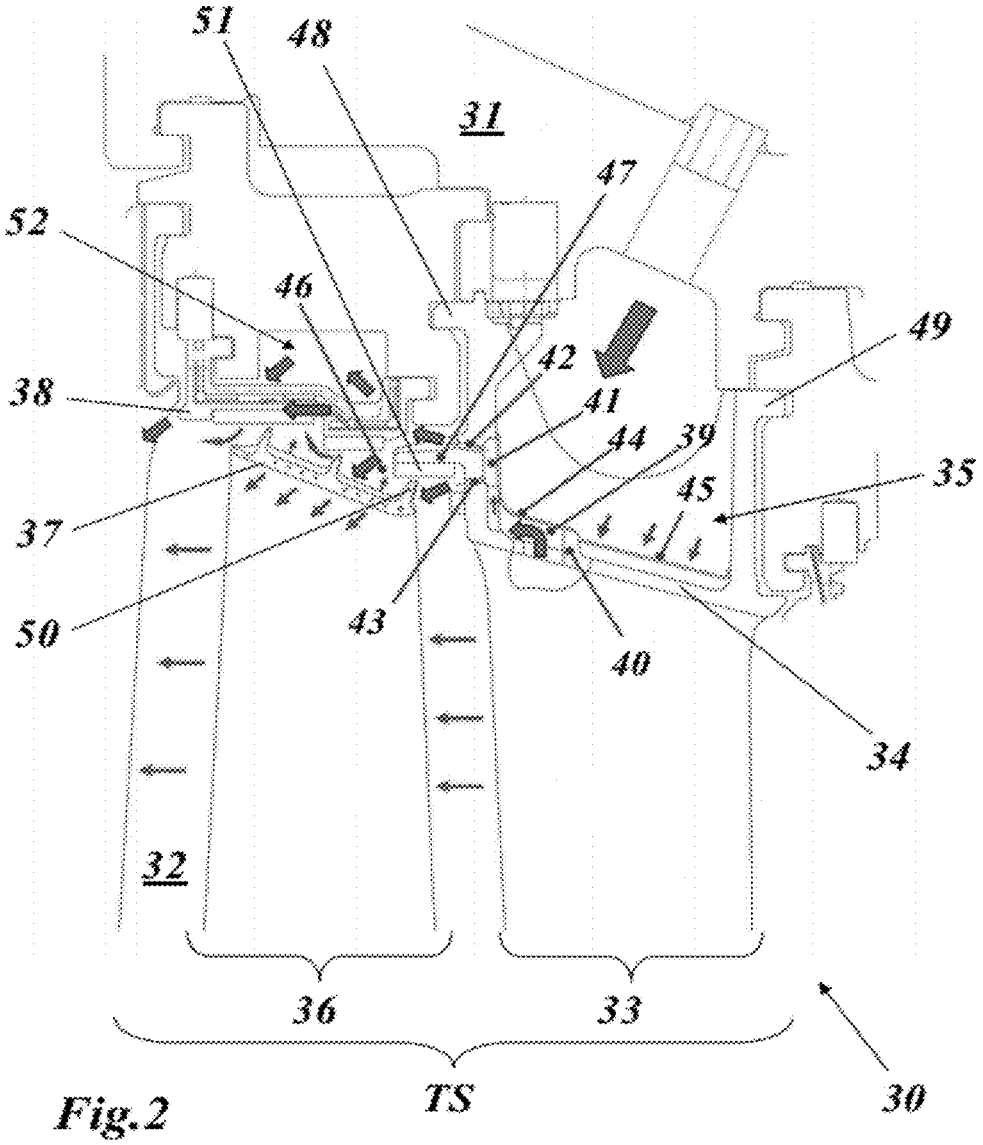
FIG. 2 shows cooling details of a turbine stage of a gas turbine according to an embodiment of the invention.

FIG. 2 presents an exemplary embodiment of a high temperature turbine stage, where cooling air is partly saved due to utilization of air used up in the vanes of the turbine stage. The gas turbine 30 of FIG. 2 includes a turbine stage TS with a row of vanes 33 followed by a row of blades 36. The blades 36 are mounted on a rotor, not shown in the Figure. The vanes 33 are mounted on a vane carrier 31, which surrounds the rotor to define a hot gas path 32. Also mounted on the vane carrier 31 are stator heat shields 38, in opposition to outer platforms 37 at the tips of the blades 36. The outer platforms 37 are provided on their outer side with several teeth, each extending in the circumferential direction. One of these teeth, the forward tooth, has the reference numeral 50.

Figure 3:
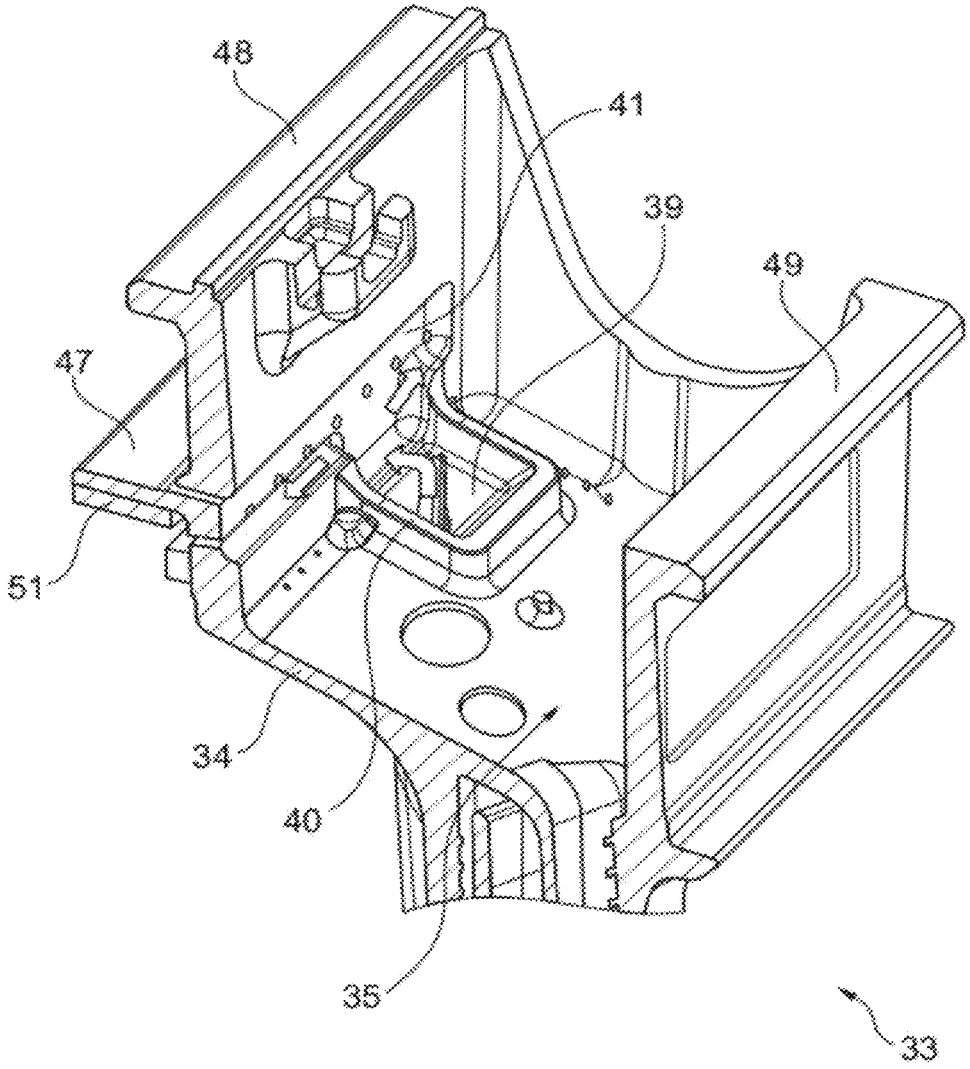
FIG. 3 shows in a perspective view the configuration of the outer platform of the vane of FIG. 2 in accordance with an embodiment of the invention, whereby all of the screens are removed.
Figure 4:
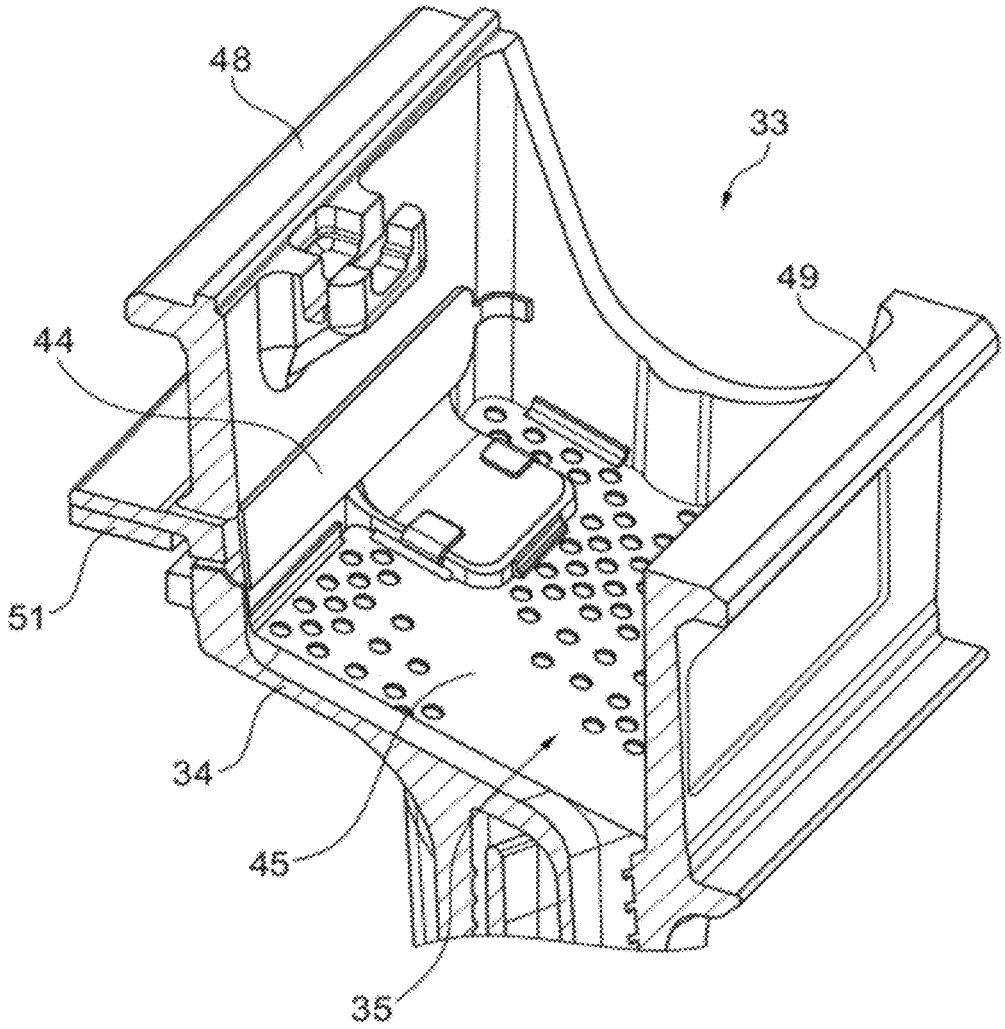
FIG. 4 shows in a perspective view the configuration of the outer platform of the vane of FIG. 3 with all of the screens put in place.
Figure 5:
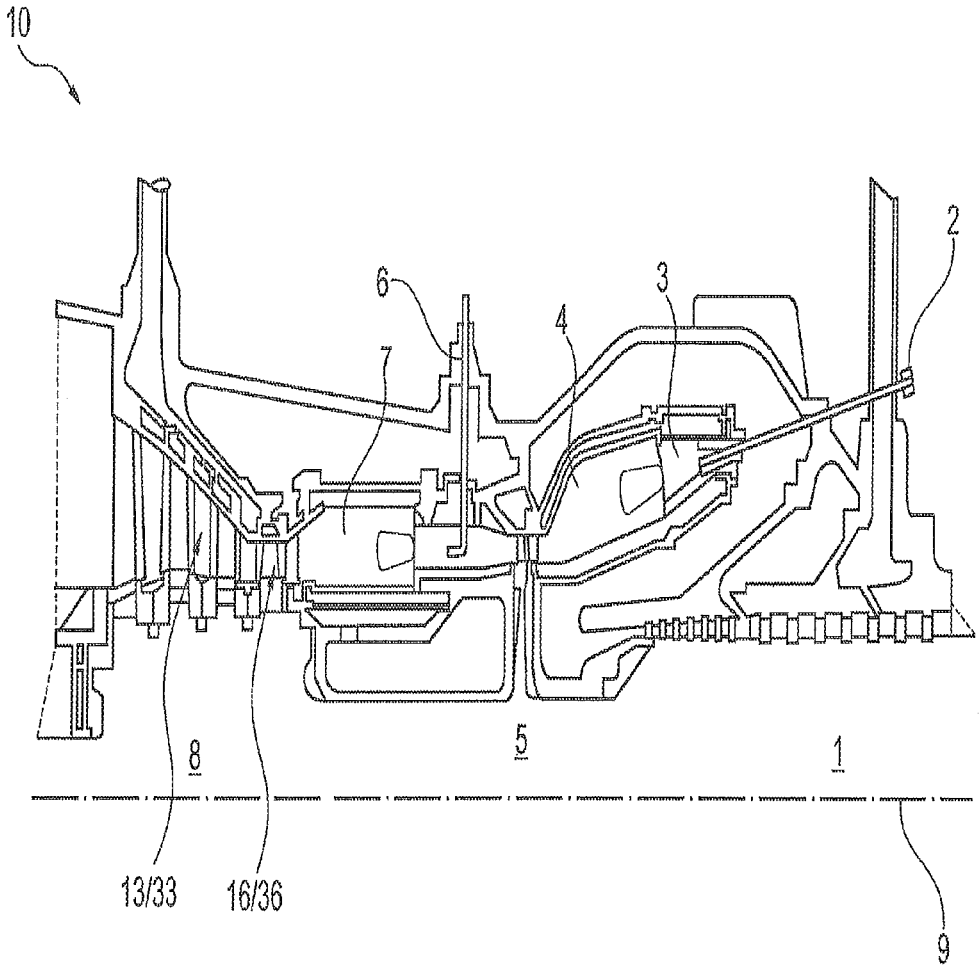
Fig. 5 PRIOR ART
FIG. 5 shows a well-known basic design of a gas turbine with sequential combustion, which may be used as a starting point for implementing embodiments of the invention.

Air used up in the vane 33 passes from the vane airfoil through the outer platform 34 into a small cavity 39 partitioned off from the basic (outer) platform 34 with a rib 40 (see FIGS. 2 and 3). The air then flows from the cavity 39 into a neighbouring cavity 41, which extends along the circumferential direction, and is distributed into two parallel rows of first and second holes 42 and 43 equally spaced in the circumferential direction (see FIGS. 2 and 3). First holes 42 direct jets of used cooling air onto the other side of rotor heat shields 38. Second holes 43 direct jets of used cooling air 1 to the forward teeth 50 of the outer blade platforms 37. The cavities 39 and 41 are closed with a common sealing screen 44 (FIG. 4). Another (perforated) screen 45 is situated above the remaining largest part of the outer platform 34, and air for cooling the platform surface and for passing into the interior of the vane airfoil passes through holes of this screen.

The efficient utilization of used-up air described above makes it possible to avoid an additional supply of fresh cooling air to the stator heat shields 38 and blade shrouds or outer platforms 37.

Another innovation of the design according to FIG. 2 is the provision of a projection 47 on the rear wall of the outer vane platform 34 (see FIGS. 2-4). This projection 47 is equipped on its lower side with a honeycomb 51. The forward tooth 50 of the outer blade platform 37 is situated under the projection 47, and this tooth 50 prevents additional leakages of used-up air from the cavity 46 between outer platform 37 and stator heat shield 38 into the turbine flow path 32.

Figure 1:
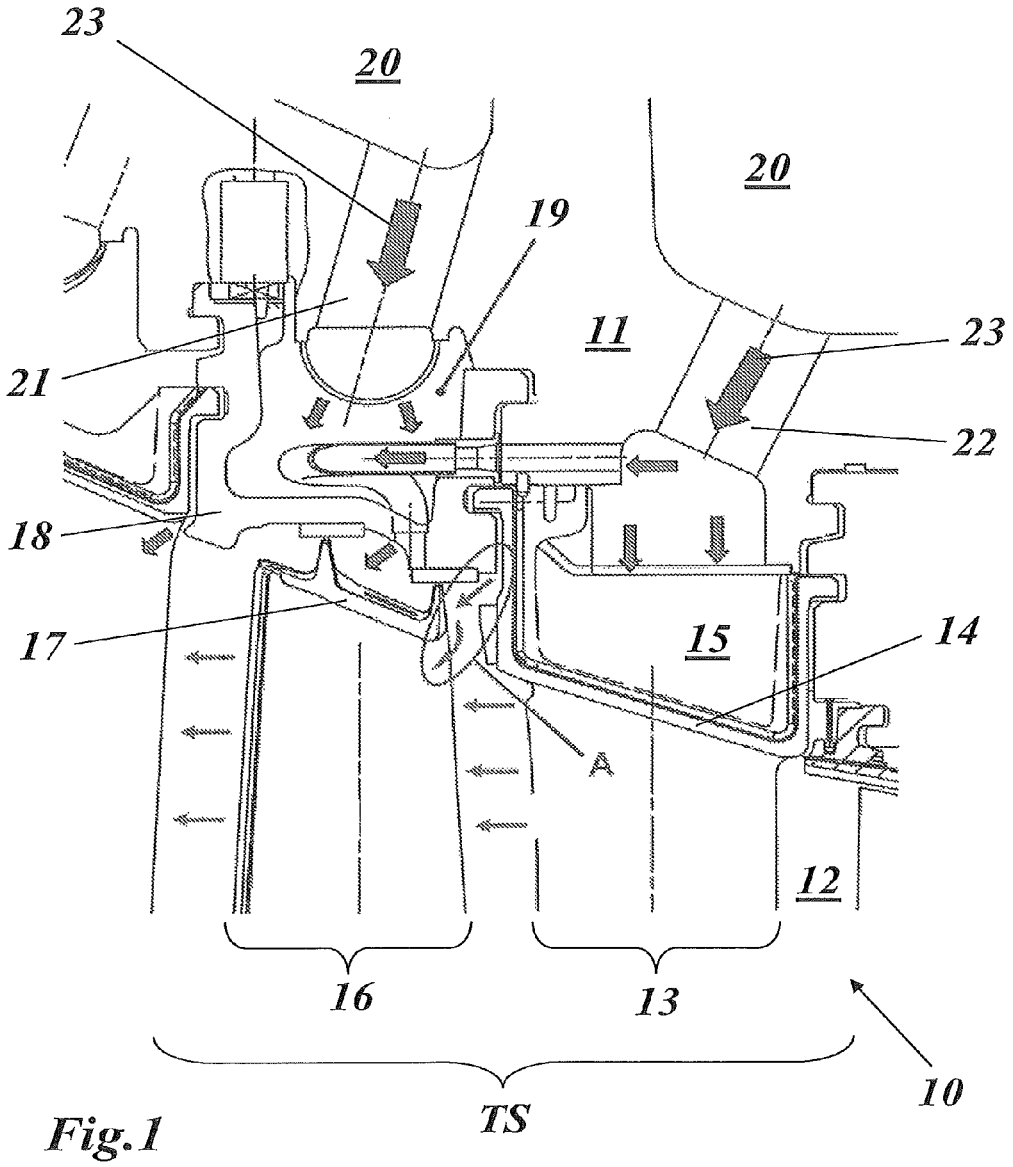
Fig.1 PRIOR ART
FIG. 1 shows cooling details of a turbine stage of a gas turbine according to the prior art.

When the proposed shape of the outer vane platform 34 according to FIG. 2 is compared with that of outer vane platform 14 presented in FIG. 1, it is clear that leakage minimization is also a result of the absence of an additional gap (see zone A marked in FIG. 1). Thus, used-up air passes without losses through the first holes 42 into the cavity 46 between a stator heat shield 38 and an outer blade platform 37. This air substantially improves the thermal state of the outer blade platforms 37 and makes it possible to avoid additional air supply for cooling the stator heat shields 38.

Used-up air passes also into a cavity 52 between the vane carrier 31 and stator heat shields 38 through gaps in part joints. Used-up air passing through the second holes 43 serves to protect the forward teeth 50 of the outer blade platforms 37.

With the foregoing, the following advantages can be achieved:

1. Air used up in a vane is then utilized to cool other parts.
2. There is no need to introduce additional air for cooling the stator heat shields.
3. The proposed shape of the outer vane platform with an additional projection 47 on its rear wall makes it possible to avoid additional cooling air leakages through the slit marked by zone A in FIG. 1.
4. Utilized air fills the cavity 52 (see FIG. 2) and protects the vane carrier 31 against overheating.

Thus, a combination of the vane with projection 47 at its outer platform 34 and a separate collector (cavity 39) for utilized air, as well as a combination of a non-cooled stator heat shield 38 and a three-pronged outer blade platform 37 with the cavity 46 formed in between, enables a modern high-performance turbine to be created.

LIST OF REFERENCE NUMERALS

1 compressor
2,6 fuel supply
3 burner
4,7 combustion chamber
5 high-pressure turbine
8 low-pressure turbine
9 axis
10,30 gas turbine
11,31 vane carrier
12,32 hot gas path
13,33 vane
14,34 outer platform (vane)
15,35 cavity
16,36 blade
17,37 outer platform (blade)
18,38 stator heat shield
19 cavity
20 plenum
21,22 cooling bore
23 cooling air
39,41,46,52 cavity
40 rib
42 hole
43 hole
44 sealing screen
45 screen
47 projection
48,49 hook
50 forward tooth (blade outer platform)
51 honeycomb
TS turbine stage While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An axial flow gas turbine comprising:

a rotor including alternating rows of air-cooled blades and air-cooled rotor heat shields, and a stator including a vane carrier, alternating rows of air-cooled vanes, and air-cooled stator heat shields mounted on the vane carrier, wherein the stator coaxially surrounds the rotor to define a hot gas path therebetween, such that the rows of blades and stator heat shields, and the rows of vanes and rotor heat shields, are correlated with each other, respectively, and a row of vanes and an adjacent row of blades in the downstream direction define a turbine stage, the vanes including airfoils and outer platforms;

a first cavity for each of the vanes located at the outer platform and at an exit of the vane for air used in the vane airfoils to pass through the outer platforms into the first cavities;

a second cavity extending in the circumferential direction and being connected to the first cavity for receiving the air from the first cavity;

a plurality of first axially oriented holes in the outer platform equally distributed along the circumferential direction, the first axially oriented holes being configured and arranged to direct used cooling air from the second cavity, the first cavity, and the airfoil of the vanes onto an outside of adjacent stator heat shields of the turbine stage, for cooling the adjacent stator heat shields, and wherein the cooling air being cooling air that has already been used to cool airfoils of the vanes of the turbine stage, and for cooling the stator heat shields of the turbine stage downstream of the vanes; and a rib which forms the first cavity, the rib comprising a frame on an upper side of the outer platform and configured to partition the first cavity from a cavity formed by the outer platform, and a sealing screen covering the frame.

2. An axial flow gas turbine comprising:

a rotor including alternating rows of air-cooled blades and air-cooled rotor heat shields, and a stator including a vane carrier, alternating rows of air-cooled vanes, and air-cooled stator heat shields mounted on the vane carrier, wherein the stator coaxially surrounds the rotor to define a hot gas path therebetween, such that the rows of blades and stator heat shields, and the rows of vanes and rotor heat shields, are correlated with each other, respectively, and a row of vanes and an adjacent row of blades in the downstream direction define a turbine stage, the vanes including airfoils and outer platforms;

a first cavity for each of the vanes located at the outer platform and at an exit of the vane for air used in the vane airfoils to pass through the outer platforms into the first cavities;

a second cavity extending in the circumferential direction and being connected to the first cavity for receiving the air from the first cavity;

a plurality of first axially oriented holes in the outer platform equally distributed along the circumferential direction, the first axially oriented holes being configured and arranged to direct used cooling air from the second cavity, the first cavity, and the airfoil of the vanes onto an outside of adjacent stator heat shields of the turbine stage, for cooling the adjacent stator heat shields, and wherein the cooling air being cooling air that has already been used to cool airfoils of the vanes of the turbine stage, and for cooling the stator heat shields of the turbine stage downstream of the vanes;

a rib which forms the first cavity, the rib comprising a frame on an upper side of the outer platform and configured to partition the first cavity from a cavity formed by the outer platform;

a recess in a rear wall of the outer platform, the recess forming the second cavity; and a sealing screen covering the first and second cavities formed by the recess and rib, respectively.

* * * * *